United States Patent [19]

Bagus

[11] 4,227,432

[45] Oct. 14, 1980

[54] ELECTRONIC MUSICAL INSTRUMENT HAVING MULTIPLEXED KEYING

[75] Inventor: Brian M. Bagus, Bartlett, Ill.

[73] Assignee: Marmon Company, Chicago, Ill.

[21] Appl. No.: 880,819

[22] Filed: Feb. 23, 1978

[51] Int. Cl.[2] ..... G10H 1/00

[52] U.S. Cl. ..... 84/1.01; 84/1.17; 84/1.23

[58] Field of Search ..... 84/1.01, 1.11, 1.19, 84/1.21, DIG. 22, 1.17, 1.22, 1.23, 345

[56] References Cited

U.S. PATENT DOCUMENTS

| | | | |
|---|---|---|---|
| 3,610,799 | 10/1971 | Watson | 84/1.01 |
| 3,916,750 | 11/1975 | Vetrecht | 84/1.01 |
| 3,990,339 | 11/1976 | Robinson et al. | 84/1.17 |
| 4,018,125 | 4/1977 | Nishimoto | 84/1.19 |
| 4,038,896 | 8/1977 | Faulkner | 84/1.01 |
| 4,106,384 | 8/1978 | Whittington et al. | 84/1.19 |
| 4,114,497 | 9/1978 | Hiyoshi et al. | 84/1.19 |

*Primary Examiner*—Gene Z. Rubinson
*Assistant Examiner*—Forester W. Isen
*Attorney, Agent, or Firm*—Neuman, Williams, Anderson & Olson

[57] ABSTRACT

An electronic musical instrument having tone signal sources and keyers for the tone signal sources has a time division multiplexer for multiplexing the key-down information in groups such as for the upper manual, lower manual and pedals. The keyers are provided in divider keyer packages with drawbar, or harmonic content, information being synchronously multiplexed with the key-down information to a single set of keyers.

10 Claims, 8 Drawing Figures

ELECTRONIC MUSICAL INSTRUMENT HAVING MULTIPLEXED KEYING

BACKGROUND OF THE INVENTION

1. Field of the Invention

The field of the invention is electronic musical instruments.

2. Description of the Prior Art

Multiplexing for electronic musical instruments, so far as applicant is aware, has in the past been limited to time division multiplexing of keyboard information, converting parallel key-down information to serial data. A multiplexing scheme for multiplexing couplers is shown in U.S. Pat. No. 3,614,287 to Klann.

SUMMARY OF THE INVENTION

One embodiment of the present invention is an electronic musical instrument comprising a plurality of groups of key selector outputs, there being several key selector outputs in each group; there being several harmonic content signal outputs in each group; first signal outputs, multiplexing means for time division multiplexing a different key selector output from each of the groups of key selector outputs into a plurality of time intervals on each of several different outputs; second multiplexing means for time division multiplexing a different harmonic content signal output into a plurality of time intervals on each of several different outputs; a plurality of keyer means each coupled to an associated different one of said multiplexed harmonic content signal outputs and a different one of said multiplexed key selector outputs; master oscillator means for providing audio frequency range square wave tone signals to each of said keyer means and for providing a synchronous clock signal to both said first and second multiplexer; each of said keyer means produces a time division multiplexed keyer tone output which is related to the time division multiplexed harmonic content signal, the time division multiplexed key selector signal, and the master oscillator tone signal; deximultiplexer means receiving said time division multiplexed keyer tone output and for receiving said synchronous clock signal from said master oscillator and providing a demultiplexed keyer tone signal and means for producing musical sounds in response to said demultiplexed keyer tone output.

DESCRIPTION OF THE PREFERRED EMBODIMENT

Figure 1:
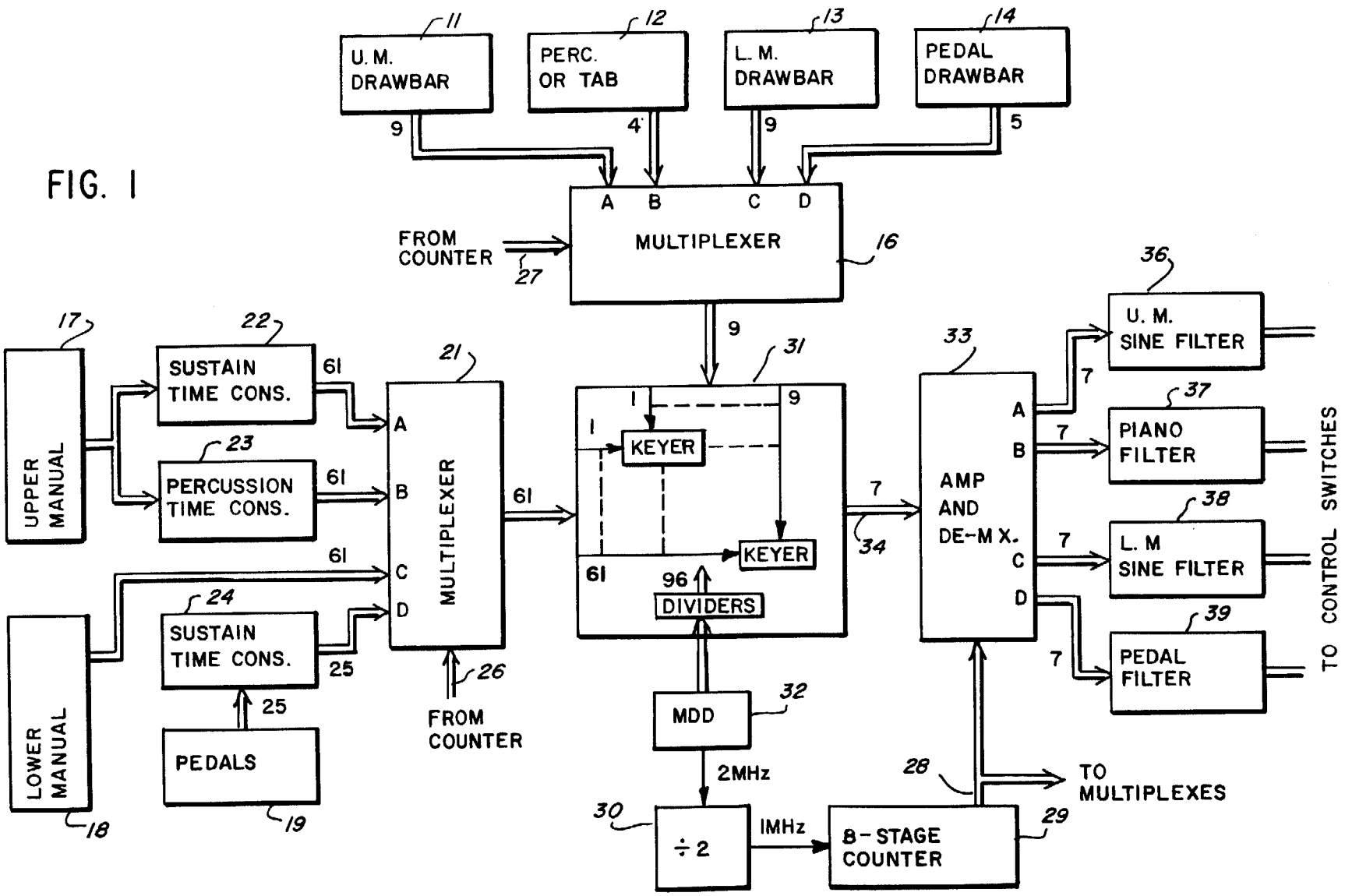
FIG. 1 is a block diagram of an electronic organ according to an embodiment of the present invention.

Referring in particular to FIG. 1, there is shown a block diagram of the circuitry of an embodiment of the present invention. The basic circuitry is for an electronic organ of the type wherein the harmonic content of tones energized by depressed keys or pedals is determined by a variable voltage drawbar or other device and in which key-down or pedal-down information is coupled to a divider-keyer circuit along with the harmonic content information to provide a filterable audio output for the electronic organ. The basic non-multiplexed keying system which forms a basis for the presently described embodiment is as shown in U.S. Pat. No. 3,636,231 to Ray Schrecongost, et al and U.S. Pat. No. 3,748,944 to Ray Schrecongost, both of which are assigned to the assignee of the present application. In the present system, the harmonic content information for each key or pedal board is multiplexed in synchronization with the key-down or pedal-down information for the corresponding keyboard or pedal board. In this way, the number of divider-keyers necessary is reduced by, in the exemplary embodiment, a factor of four.

Voltage setting information from the nine upper manual drawbars 11, four percussion presets 12, nine lower manual drawbars 13 and five pedal drawbars 14 is coupled to the four inputs of multiplexer 16. Similarly, key-down information from the 61-key upper manual 17, 61-key lower manual 18 and 25 pedals 19 is coupled to multiplexer 21. The upper manual information is coupled through both a sustain time constant envelope generator 22 and a percussion time constant envelope generator 23. The pedal-down information from pedals 19 is coupled through a sustain time constant envelope generator 24. The multiplexer 21 and multiplexer 16 both receive time segment coding information on lines 26 and 27, respectively. These signals are obtained from outputs designated generally as 28 of counter circuit 29.

The drawbar information from the four drawbar or tab sources is multiplexed into four time intervals by multiplexer 16 while the corresponding information is synchronously multiplexed from the manuals and pedals by multiplexer 21. Therefore, for example, the upper manual drawbar information 11 is in the first time segment as established by multiplexer 16 and the upper manual key-down information from upper manual 17 through sustain time constant envelope generator 22 is placed in the corresponding first of four time segments by multiplexer 21. Thus, the four pairs of drawbar and key-down information are synchronously coupled to divider-keyer circuit 31, thereby time sharing a set of divider-keyers in circuit 31 which is normally used for a single keyboard.

Multiple Derivative Divider (MDD) 32 provides the master oscillator signal to the divider-keyer circuit 31. MDD 32 also provides an, approximately, two megahertz multiplexing clock signal which is divided down to approximately one megahertz for counter 29. Since the tone signals and multiplexing pulse signals are derived from the same generator, interference and beats between them are essentially eliminated. This common source of both signal types is particularly important when the MDD is vibrated or transposed.

Bus amplifier and demultiplexer circuit 33 is clocked by counter 29 synchronously with the multiplexers 21 and 16. Therefore, the multiplexed output of divider-keyer circuit 31 is demultiplexed and coupled on four sets of seven frequency-grouped lines to the four filter circuits appropriate for each of the manuals initiating the signals. Thus there is provided an upper manual filter section 36, a piano, or percussion, filter section 37, a lower manual filter section 38 and a pedal filter section 39. The outputs of these filters are coupled thereafter to control switches and the sound producing amplification and speaker systems of the organ.

Figures 2, 3:
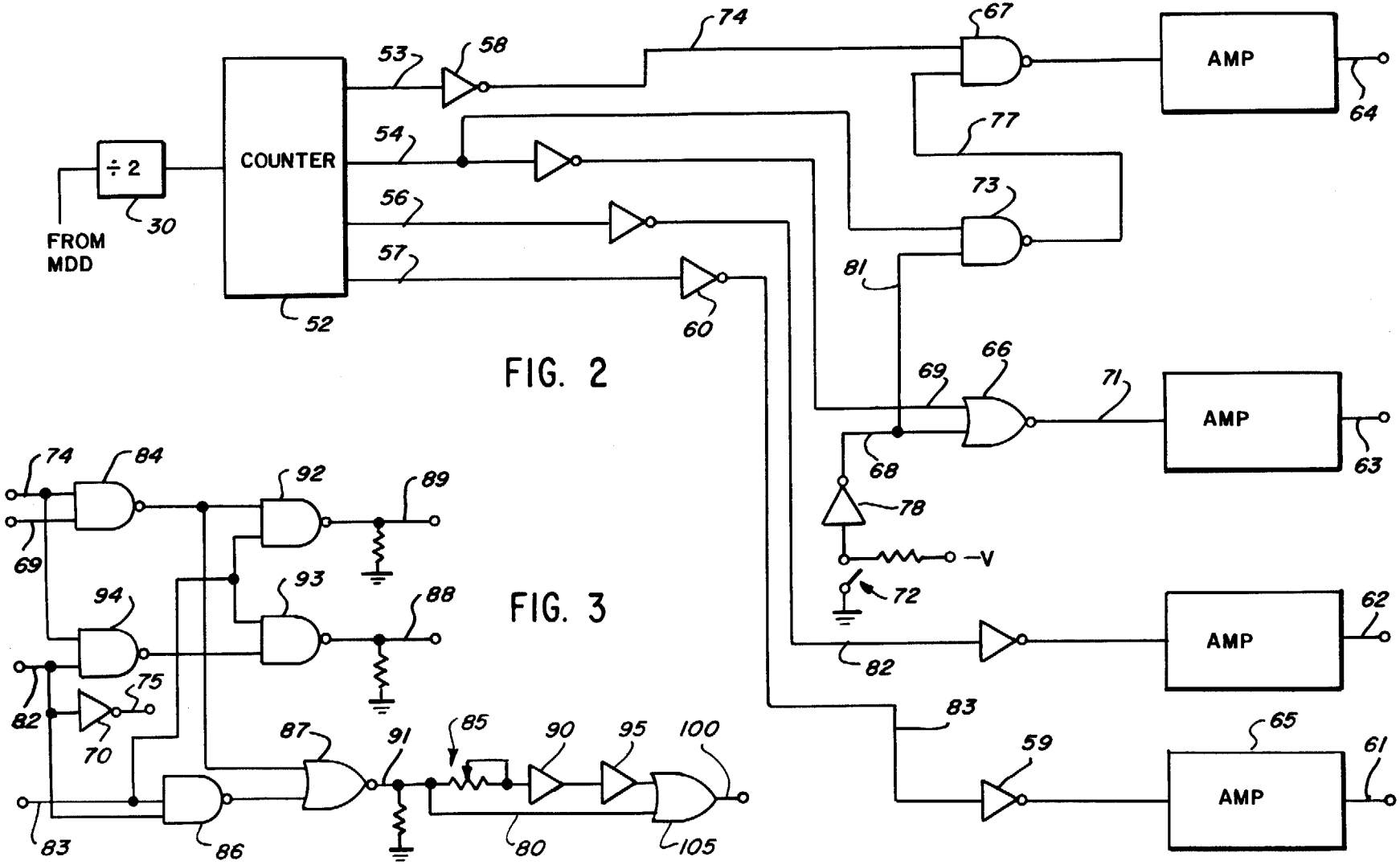
FIG. 2 is a more detailed showing of the counter and key-down multiplexer pulse generating circuitry of FIG. 1.
FIG. 3 is a more detailed showing of the multiplexer pulse generating circuitry for the drawbar multiplexer of FIG. 1.

Referring now to FIG. 2, there is shown the eight stage counter circuit 29 (FIG. 1) in more detail with divide-by-two circuit 30 coupled from the MDD 32 (FIG. 1). After the clock signal from the MDD is coupled through buffer and divide-by-two circuit 30, the divided signal coupled (as an approximately 1 Mhz signal) to the input of an eight stage counter 52. Counter 52 produces a "high" pulse on each of eight output lines sequentially in eight time segments before resetting and repeating. For the logic circuitry described in the present embodiment of the invention, a "plus" or "high" pulse is at a voltage level of zero; and a "minus" or "low" condition is approximately minus 14 volts.

There is a twelve and one-half percent duty cycle for each of the counter output pulses. Outputs 53, 54, 56 and 57 are the first, third, fifth and seventh time segment outputs, respectively. Therefore, there is an available inhibit time segment between each of the time segments pulsed on the four output lines. Each line is inverted by an inverter such as 58 or 60 and each inverter output provides an appropriate time interval enable pulse to pass key down-information from each keying section to the divider-keyers; that is: upper manual sustain, upper manual percussion, lower manual or pedal key sections.

Output line 57 from counter 52, after passing through inverter 60, passes through another inverter 59 and waveshaping and amplification circuitry 65 to produce at output 61 a relatively rectangular negative-going 23 volt pulse. Output line 56 couples its counter output through similar inversion, shaping and amplifying circuitry to produce a similar pulse in the next earlier time segment on output line 62.

Assuming for the moment that NOR gate 66 passes the low pulse on line 69, output line 63 also produces a negative-going 23 volt squared pulse in the next earlier time segment. Finally, assuming that NAND gate 67 passes the low pulse on line 74, output line 64 produces a negative-going squared 23 volt pulse in the first time segment of the four above-described spaced time segments.

NOR gate 66 is used to eliminate the output pulse from line 63 so that upper manual key-down information from percussion time constant envelope generator circuit 23 may be replaced by the sustain time constant envelope generator output by placing a second pulse, during the time segment, on output 64 instead. If the control voltage on line 68 to one input of NOR gate 66 is low, the low-going pulse on input 69 to NOR gate 66 will cause the gate output 71 to pulse high. This high pulse is processed by waveshaping and amplifying circuitry to produce the desired pulse on line 63. If the control voltage on line 68 is high, the output of gate 66 on line 71 will remain low regardless of pulsing on input 69.

When sustain time constant envelope upper manual keying waveforms instead of percussion, waveforms are to be paired with the percussion drawbars or tabs, switch 72 is opened (as shown) putting a high input on line 68 to one input of both NOR gate 66 and NAND gate 73. The high input to gate 66 ensures a low output and removes pulses from output 63. For the upper manual continuous keying envelope time segment pulse generation, line 53 pulses high and the output of inverter 58 on line 74 pulses low as one input to NAND gate 67. The input on line 77 to NAND gate 67 is always high during the time when the signal on line 74 pulses low, producing a high-going pulse on output line 76 during the first of the four time segments. This pulse is shaped by a standard shaping and amplification network with its output on line 64.

The four time segments shall be referred to hereinafter as A (upper manual), B (percussion), C (lower manual) and D (pedals). During time interval A, upper manual sustain time constant envelope key-down information is enabled, and the upper manual nine drawbar voltages are simultaneously fed to the divider-keyers. During interval B, upper manual percussed key-down envelope information is synchronously provided to the divider-keyers with percussion tab information. Similarly, intervals C and D are for synchronous provision of lower manual and pedal information, respectively. Of course, key-down information from one time interval may be alternatively or additionally synchronized with harmonic content information from another interval. The same technique may be utilized to provide classical intermanual coupling such as pedals to lower manual. If a sustain time constant envelope upper manual keying waveform is to be obtained from the upper manual during time interval B as well as time interval A, the appropriate signal input on line 77 to NAND gate 67 is necessary.

In order to obtain the proper signal on line 77, switch 72 is opened making the output of inverter 78 high. This high input to NOR gate 66 holds output line 71 low. This high on line 68 provides a high input on line 81 to NAND gate 73. The other input to NAND gate 73 is from line 54 and is normally low, pulsing high during time segment B. Therefore, the output of NAND gate 73 on line 77 is held high, pulsing low during time segment B. The low pulse during time segment B on line 77 causes a high pulse on output line 76 during time segment B since the other input to NAND gate 67 on line 74 is high during time segment B. When pulses for time segment B are provided on lines 71 and 63, switch 72 is closed and the input on line 81 to NAND gate 73 is low holding output 77 high.

The synchronized time segment pulses A, B, C and D for driving the multiplexer 16 (FIG. 1) for harmonic content, or drawbar, information and for driving the demultiplexer, are derived from the pulses on lines 74, 69, 82 and 83 of FIG. 2 occurring after the inverters on the output lines from counter 52. NAND gate 84 receives the time segment A and B pulses, which are negative-going, and NAND gate 86 receives the negative-going C and D time segment pulses. The outputs of these NAND gate are therefore low but pulsing whenever one of the low-going pulses arrives at an input to one of the NAND gates. The outputs of the NAND gates 84 and 86 are the inputs to NOR gate 87 whose output is normally high but goes low during each of the time segment pulses A through D. Thus, as will be explained in more detail subsequently, a positive inhibit pulse is available on the output of NOR gate 87 whenever a time segment pulse A through D is not present.

The high-going pulses during time slots A and B are one input to NAND gate 92 while the other input is from normally high D segment input line 83. This results in an output on line 89 of low pulses during the A and B time slots. Similarly, NAND gate 94 couples through the positive-going pulses in the A and C time intervals which are inverted by NAND gate 93 and provide on output line 88 low-going pulses during the A and C time intervals. Line 89 provides the "b" input for driving the multiplexers and demultiplexers, output line 88 is the "a" input drive to the multiplexers and demultiplexers, and output line 91 provides the "input" drive for the multiplexers, as shall be explained hereinafter.

The inhibit pulses for the demultiplexer, in order to avoid transition noise, are provided through a delay circuit. The delay circuit comprises a potentiometer 85, buffer 90, buffer 95, and OR gate 105 having an output to the inhibit inputs for the demultiplexers on line 100. Buffer 90 and buffer 95 provide delay and waveshaping. The inhibit output on line 91 to the multiplexers is high during the inhibit time. The inhibit output on line 100 to the multiplexers goes high in order to inhibit at the same time as line 91 due to the direct connection on line 80 to OR gate 105 causing line 100 to go high at the same time. However, the inhibit portion ends later for the demultiplexers due to the time delay, of approximately 200 nanoseconds, provided by buffers 90 and 95. Due to these delays, the high pulse at the upper input to OR gate 105 does not go low until the approximate 200 nanoseconds delay time after the fall of the inhibit pulse on line 91.

Figure 4:
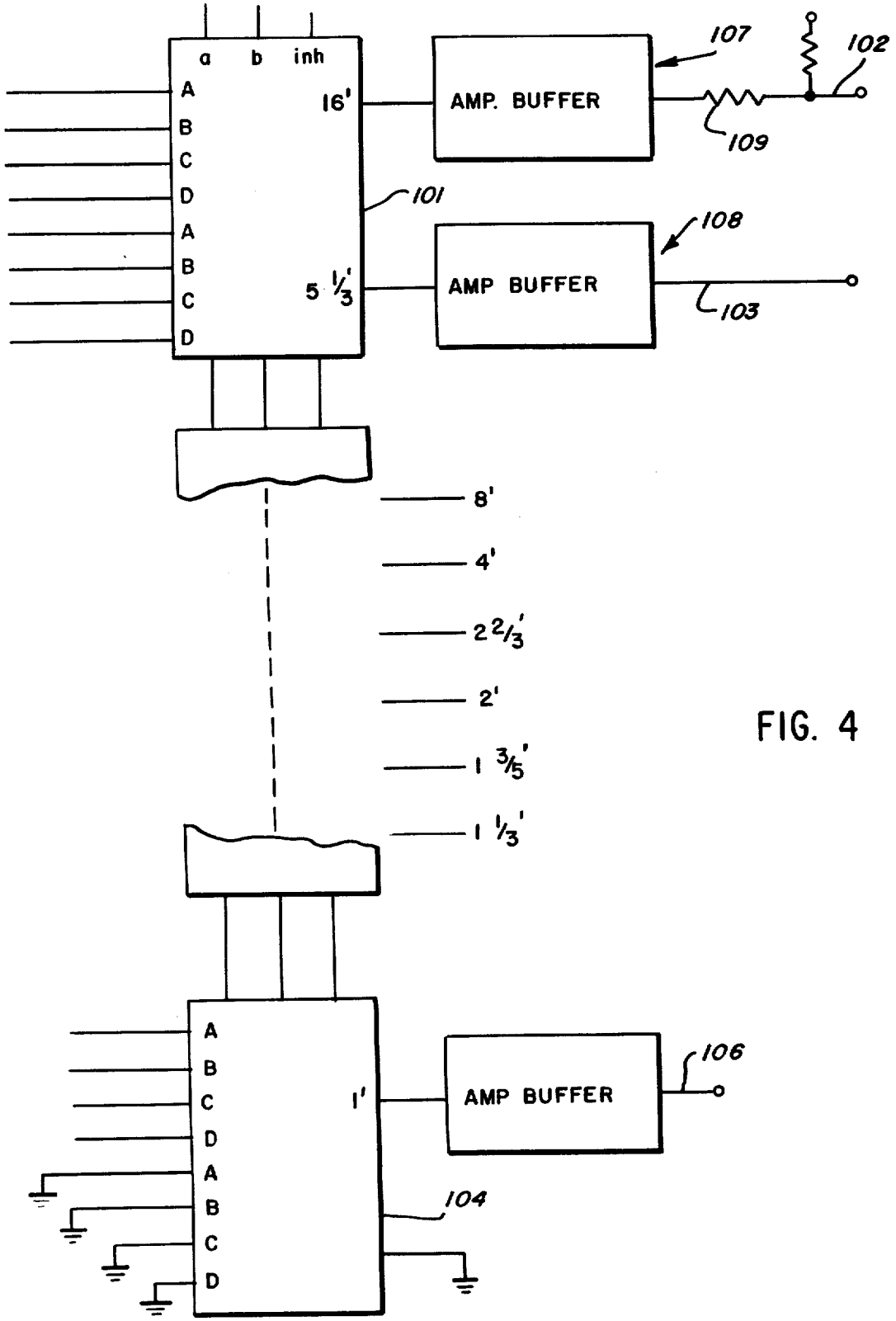
FIG. 4 is a more detailed showing of the drawbar multiplexer of FIG. 1.

Referring now to FIG. 4, there is shown the series of multiplexers such as 101 and 104 for multiplexing the upper manual sustain, upper manual percussion, lower manual, and pedal drawbar inputs during time slots A through D respectively. The input lines for controlling the multiplexing operation are lines 88, 89 and 91 from FIG. 3. The inputs to "a" and "b" of multiplexer chip 101 sequentially select drawbar inputs A through D. The inhibit pulses on line 91 inhibit reading one of the input lines between time interval pulses.

The chip 101 is preferably an RCA type CD4052. There are two sections to each chip 101 as shown in the present embodiment, and chip 101 multiplexes the drawbar information for the 16' and 5-⅓' voices. The 16' output is amplified by amplifier-buffer as 107 and the output provided on line 102 to the divider-keyers shall be explained hereinafter. The other half of the multiplexer 101 has its output amplified by amplifier-buffer section 108 and its output appears on line 103.

There is a series of two-section multiplexers utilized as shown symbolically in FIG. 4 for the 8', 4', 2-⅔', 2', 1-3/5' and 1-⅓' voices in similar paired packages as shown for multiplexer 101. A final multiplexer 104 is used to provide the 1' voice and the other half of the package in the present embodiment is not used. The output for the 1' signal after amplifying buffering is provided on line 106.

The inputs on lines A through D for the drawbar information for each footage from the four different sources which are multiplexed by multiplexer 101 and the other multiplexers is derived from standard drawbar settings such as from a range of voltages on a potentiometer or discrete voltage settings from tabs.

Thus for each footage, such as 16', the DC voltages or other control signals applied on inputs A through D from the above-described four drawbar or tab settings are time division multiplexed and coupled on an output to amplifier-buffers such as 107.

Figure 5:
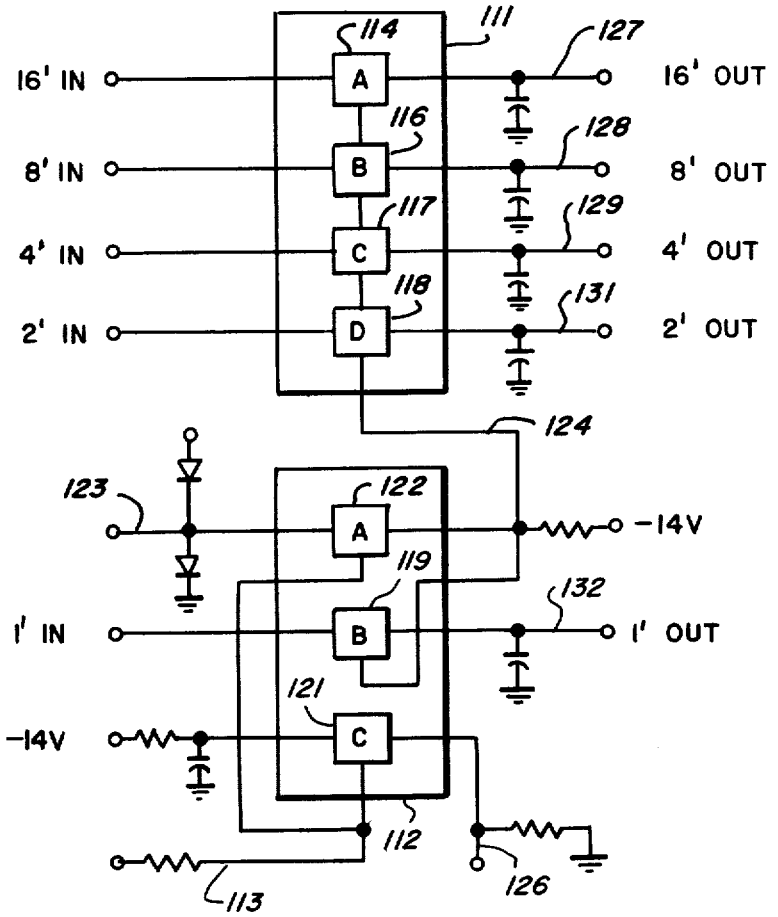
FIG. 5 shows the demultiplexing circuitry for a bright wave generating system used in association with the circuit of FIG. 1.

A sampling resistor such as 109 is provided at the 16', 8', 4', 2' and 1' voicing outputs. The sampling resistors are coupled to the respective five inputs of the demultiplexing or switching chips shown in FIG. 5. Each chip 111 and 112 contains four bilateral switches. Switches 114, 116, 117, 118 and 119 pass drawbar sample voltages for the five footages mentioned above but only during the phase C, or lower manual phase, of the multiplexing. The phase C-only control is provided by a voltage on line 113 which provides a control voltage to switches 121 and 112. The input line 123 to switch 122 carries pulses at interval C from line 75 at the output of inverter 70 (FIG. 3). When the bright wave control line 113 is activated, switch 122 passes these pulses to control line 124 which supplies the phase C-only control to the five footage switches 114 through 119 as mentioned. The drawbar input for the five above-mentioned footages are placed at a maximum, and the other drawbar inputs turned off, by a bright wave enable signal on line 126 coupled through switch 121 due to the control voltage on line 113. The five bright wave outpts 127 through 132 are later proportioned by another set of voicing circuits.

Figure 6:
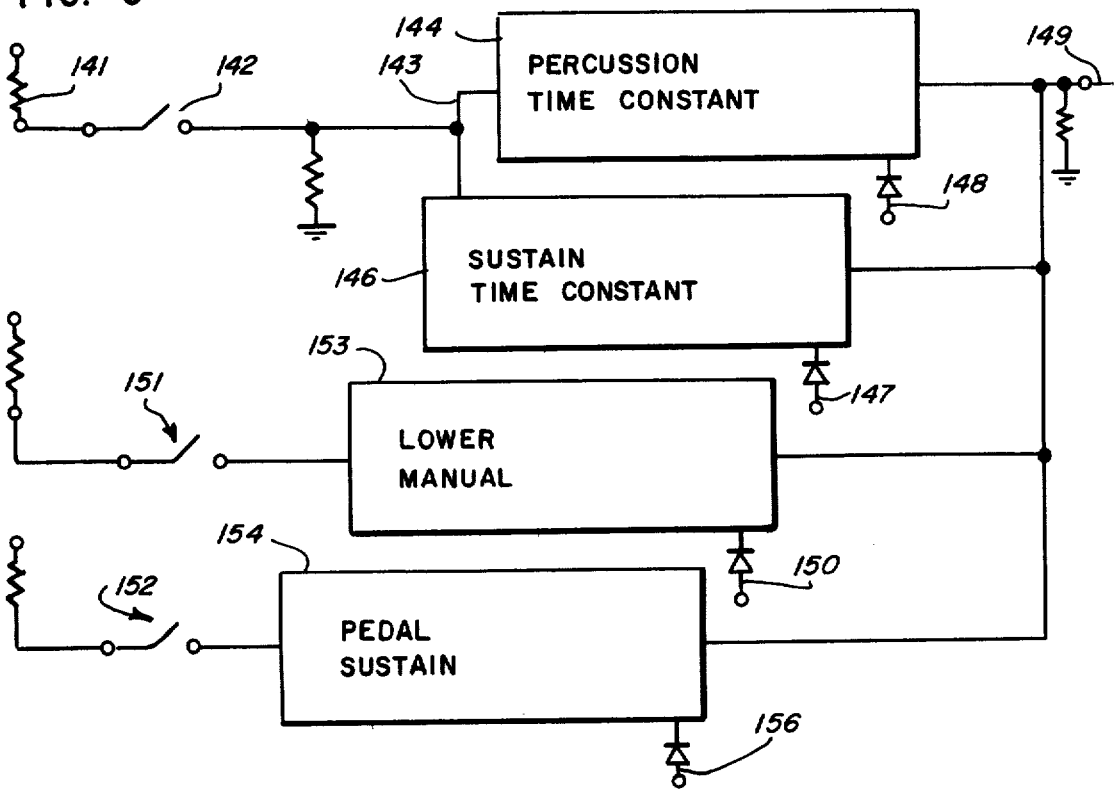
FIG. 6 shows in more detail the key-down multiplexing system of FIG. 1.

In FIG. 6 there is shown an exemplary key for each of the three keying circuits, upper manual, lower manual and pedals, in the present electronic organ embodiment. The upper manual bus voltage is fed through a resistor 141 to a typical upper manual key switch 142, the typical upper manual having 61 keys. The keydown voltage through switch 142, when it is closed, is coupled on line 143 to percussion time constant envelope generation circuitry 114 and also upper manual sustain time constant envelope generation circuitry 146. This circuitry is standard and will not be discussed in detail in this application. The upper manual envelope generation circuitry 146 is gated by the phase A pulse input on line 147, coupled from line 64 (FIG. 2), to provide an output at 149 during phase A of the multiplexing sequence. The phase B pulse is received on line 148, from line 63 (FIG. 2), allowing key-down information through the percussion keying envelope circuitry to be placed on output line 149 during interval B.

Similarly, bus voltage is couplable through key switch 151 of the lower manual through lower manual envelope generation circuit 153 and gated on by the phase C pulse input at 150, coupled from line 62 (FIG. 2). The output from filter circuit 153 during phase C is also coupled to output line 149. Finally, the pedal bus voltage is couplable through pedal switch 152, when it is closed, and then through sustain envelope circuitry 154 and fed to output 149 during phase D as determined by the phase D pulse on line 156, from line 61 (FIG. 2). The multiplexed key-down information on line 149 is coupled to the divider-keyer circuitry 31 (FIG. 1).

Figure 7:
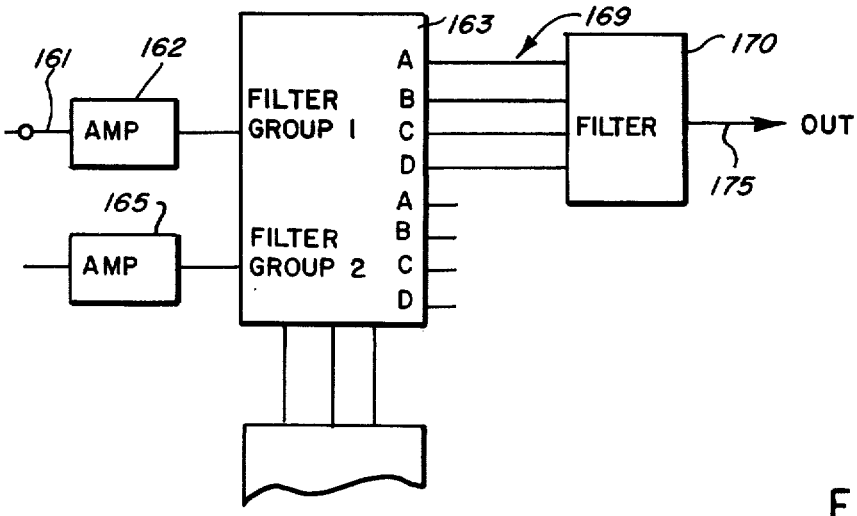
FIG. 7 is a more detailed showing of the demultiplexing circuitry of FIG. 1.

Referring now to FIG. 7 there is shown the demultiplexing circuitry for the present embodiment. Input lines such as 161 from the outputs of the divider-keyers are coupled through an amplifier 162 to demultiplexer circuits such as 163. Each input such as the lowest frequency filter group one input has one-half of a chip such as 163 devoted to it. Similarly, the collection of filter group two outputs from the divider-keyers is coupled through an amplifier 165 to the other half of chip 163.

There are three other demultiplexer chips as figuratively shown, with a showing at the bottom of FIG. 7 of the highest filter group seven divider-keyer output being amplified and coupled to one half of demultiplexer chip 168. All of the demultiplexer chips have the "a", "b" and "inhibit" signals coupled in on lines 164, 166 and 167, respectively. The signals on these lines with the exception of "inhibit" are the same as those derived for the multiplexer chips described above in FIG. 4. The demultiplexer chip circuit such as 163 and 168 are type CD4052 demultiplexer chips such as those described above for the multiplexing operation. The information during each (A through D) time interval for each filter group which is fed into each half chip is demultiplexed and fed out on output lines according to the appropriate channel or time slot A, B, C or D as shown at 169 for example. Each of these outputs is fed to an appropriate filter such as 170 as in common practice for synthesis electronic organs. An additional high pass filter circuit is shown at 171 and is used for the seventh, or highest, note group. It should be noted that a storage capacitor such as 172 is provided for each filter output network for charge storage between segments of the signal at the appropriate time slot. For example, the phase A signal on output line 173 which is coupled to one side of capacitor 172 and filter network 171 occurs only approximately ⅛ of the time for a twelve and one-half percent duty cycle and the level of the signal is maintained between times through the use of capacitor 172. The exemplary 0.01 uf capacitor 172 operates in a sample and hold fashion off of switching chip 168 and in parallel with the output filters to maintain signal level and provide a good signal to noise ratio. The output of each filter network such as 170 is coupled to an amplifier and speaker system as desired.

Figure 8:
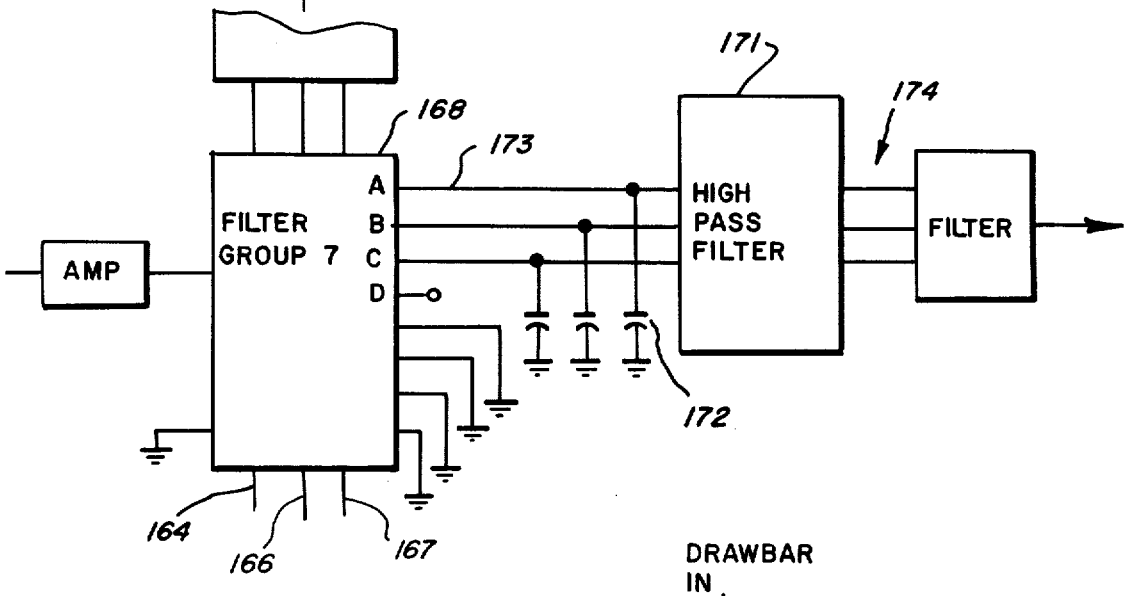
FIG. 8 shows a typical keyer for the divider-keyer section of FIG. 1.
Figure 8:
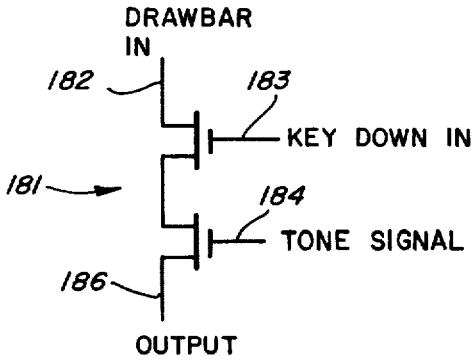

For completeness of illustration, a typical keyer which might be utilized for the present embodiment is shown. This type of keyer is explained, as indicated above, in U.S. Pat. Nos. 3,636,231 and 3,748,944, assigned to the assignee of the present application. Essentially, a keyer such as 181 shown in FIG. 8 is associated with each combination of drawbar or tab setting line 182 and key-down signal line 183.

For a given section of the organ, such as the lower manual, the tone signal such as on line 184 would also be provided to several other keyers such as 181 where that tone signal might be the tone for a different harmonic for a different key which is depressed. In the keyer 181 the tone signal is keyed by a key-down signal on line 183 and scaled by the drawbar voltage on line 182 to produce an output on line 186 which is then filtered and otherwise processed as desired to produce musical tones. In the multiplexing scheme described hereinabove, the typical keyer circuit shown in FIG. 8 would be utilized in four different time intervals corresponding to the upper manual sustain time constant interval A, upper manual percussion time constant interval B, lower manual interval C and pedal interval D. Thus, for example, the keyer for the third harmonic of middle C would be successively actuable in each of the four time intervals with different footage scaling signals and different key selector signals.

The details of a divider-keyer system for a single organ manual are contained in U.S. Pat. No. 3,748,944, mentioned above. It is within the scope of the presently described embodiment to utilize such a system or a similar system in a time division multiplex arrangement for a plurality of manuals and/or pedal boards.

What is claimed is:

1. An electronic musical instrument comprising:

a plurality of key down selection sources, each having a group of key down output lines and each providing key down selection signals on respective ones of said group of key down output lines;

first multiplexer means having a plurality of first multiplier output lines for time division multiplexing different ones of said key down selection signals from selected ones of said groups of key down output lines into a plurality of time intervals on each of said plurality of first multiplexer output lines;

a plurality of analog harmonic signal sources, each having a group of harmonic output lines and each providing harmonic value signals on respective ones of said group of harmonic output lines;

second multiplexer means having a plurality of second multiplexer output lines for time division multiplexing different ones of said harmonic value signals from selected ones of said groups of harmonic output lines into a plurality of time intervals on each of said plurality of second multiplexer output lines;

a top octave signal source having a plurality of top octave output lines and providing various frequency range signals on each of said top octave output lines;

a plurality of keyer means each having a keyer output line and each being coupled to said first multiplexer means for receiving a different one of said time division multiplexed key down signals, to said second multiplexer means for receiving said time division multiplexed harmonic value signals and to said top octave signal source for receiving selected ones of said various frequency range signals;

each of said plurality of keyer means providing on said keyer output line a time divisioned multiplexed signal related to said selected various frequency range signals received by said keyer;

demultiplexer means having a plurality of demultiplexer output lines and being coupled to said plurality of keyer means for receiving said time division multiplexed signals related to said selected various frequency range signals received by each said keyer and providing on said plurality of demultiplexer output lines a plurality of demultiplexed output signals; and output circuit means coupled to said demultiplexer means for receiving said plurality of demultiplexed output signals and producing a plurality of audio frequency range signals.

2. An electronic musical instrument as set forth in claim 1 wherein individual ones of said plurality of groups of key down output lines are selected sequentially for time division multiplexing into a plurality of time intervals.

3. An electronic musical instrument as set forth in claim 1 wherein individual ones of said plurality of groups of key down output lines are selected in a predetermined order for time division multiplexing into a plurality of time intervals.

4. An electronic musical instrument as set forth in claim 1 or 3 further including clock signal means having a plurality of clock output lines and being coupled to said top octave signal source for deriving synchronous clocking signal; and, said plurality of clock output lines being respectively coupled to said first multiplexer, said second multiplexer and said demultiplexer for transmitting said synchronous clocking signal.

5. An electronic musical instrument as set forth in claim 4 wherein time division multiplexed key down selection signals in one time interval are synchronized with time division multiplexed harmonic value signals in a different time interval.

6. An electronic musical instrument as set forth in claim 4 wherein time division multiplexed key down selection signals in one time interval are synchronized with time division multiplexed harmonic value signals in the same time interval.

7. An electronic musical instrument as set forth in claim 6 wherein said key down selection sources comprise a first keyboard, a second keyboard and a pedal board.

8. An electronic musical instrument as set forth in claim 7 wherein said harmonic value signals of one of said plurality of harmonic signal sources and said key down selection signals of said first keyboard are each time division multiplexed into the same time interval, said harmonic value signals of another one of said plurality of harmonic signal sources and said key down selection signals of said second keyboard are each time division multiplexed into another time interval, and said harmonic value signals of yet another one of said plurality of harmonic signal sources and said key down selection signals of said pedal keyboard are time division multiplexed into yet another time interval.

9. An electronic musical instrument as set forth in claim 7 further comprising:

a sustain time constant circuit having a plurality of sustain output lines and receiving said group of key down output lines from said first keyboard and providing a plurality of sustained key down selection signals on said plurality of sustain output lines; and a percussion time constant circuit having a plurality of percussion output lines and receiving said group of key down output lines from said first keyboard and providing a plurality of percussed key down selection signals on said plurality of percussion output lines.

10. An electronic musical instrument as set forth in claim 9 further comprising:

a pedal sustain time constant circuit having a plurality of pedal sustain output lines and receiving said group of key down output lines from said pedal keyboard and providing a plurality of pedal sustain key down selection signals on said plurality of pedal sustain output lines.

* * * * *